US008024923B2

(12) United States Patent
Matsumoto

(10) Patent No.: US 8,024,923 B2
(45) Date of Patent: Sep. 27, 2011

(54) AIR CYLINDER APPARATUS

(75) Inventor: Takumi Matsumoto, Tsukubamirai (JP)

(73) Assignee: SMC Corporation, Tokyo (JP)

( * ) Notice: Subject to any disclaimer, the term of this patent is extended or adjusted under 35 U.S.C. 154(b) by 619 days.

(21) Appl. No.: 12/124,474

(22) Filed: May 21, 2008

(65) Prior Publication Data

US 2009/0007771 A1 Jan. 8, 2009

(30) Foreign Application Priority Data

Jul. 3, 2007 (JP) ..... 2007-175140

(51) Int. Cl.
*F15B 15/14* (2006.01)
*F15B 11/06* (2006.01)

(52) U.S. Cl. ..... 60/407; 91/459

(58) Field of Classification Search ..... 60/407; 91/459, 462, 466

See application file for complete search history.

(56) References Cited

U.S. PATENT DOCUMENTS

| | | | | |
|---|---|---|---|---|
| 6,455,800 | B1 | 9/2002 | Janssens et al. | |
| 6,755,115 | B2 * | 6/2004 | Stoll et al. | 91/363 R |
| 2005/0229593 | A1 | 10/2005 | Matsumoto et al. | |

FOREIGN PATENT DOCUMENTS

| | | |
|---|---|---|
| JP | 2002-224846 | 8/2002 |
| JP | 2005-282796 | 10/2005 |

* cited by examiner

*Primary Examiner* — Thomas E Lazo
(74) *Attorney, Agent, or Firm* — Oblon, Spivak, McClelland, Maier & Neustadt, L.L.P.

(57) ABSTRACT

An electromagnetic valve, a circuit board on which a control circuit for controlling the electromagnetic valve is mounted, and a cover for covering the electromagnetic valve and the circuit board are installed on a device-attaching surface of an adapter plate disposed at one end in a direction of an axial line of an air cylinder, in a manner so as to be housed within a surface area of the device-attaching surface, and an output port of the electromagnetic valve and a pressure chamber of the air cylinder are allowed to communicate with each other through an air through-hole provided in the adapter plate.

14 Claims, 5 Drawing Sheets

AIR CYLINDER APPARATUS

TECHNICAL FIELD

The present invention relates to an air cylinder apparatus in which an air cylinder being driven by pressurized air is integrally assembled with an electromagnetic valve, a circuit board, or the like for controlling the air cylinder.

BACKGROUND ART

In general, an air cylinder apparatus, in which an air cylinder being driven by pressurized air is integrally assembled with an electromagnetic valve, a circuit board, or the like for controlling the air cylinder, is hitherto known as, for example, disclosed in the following patent document 1, patent document 2, and so forth. These air cylinder apparatuses are used, for example, as welding guns for performing a spot-welding operation for automobile parts and so forth, actuators for performing a clamping operation, conveying operation, picking operation, or the like for parts in an automated assembling line for products, and so forth. The air cylinder apparatus is required to be small-sized, light-weighted, and air piping, transmission wires for transmitting drive power force, control signals, or the like in the air cylinder apparatus are required to be disposed in a manner so as not to disturb the work.

However, in the hitherto known air cylinder apparatus, the electromagnetic valve is attached on a side surface of the air cylinder and the air piping that connects the electromagnetic valve and a pressure chamber in an inside of the air cylinder is disposed in a manner so as to pass through an outside of the air cylinder. Thereby, depending on an intended purpose of the air cylinder apparatus, the electromagnetic valve, the air piping, or the like sometimes disturbs the work. In addition, there sometimes has also been a case that the electromagnetic valve, the air piping, or the like disturbs the work in a case that the air cylinder apparatus is required to be more small-sized.

Patent Document 1: Japanese Unexamined Patent Application Publication No. 2002-224846

Patent Document 2: Japanese Unexamined Patent Application Publication No. 2002-282796

DISCLOSURE OF INVENTION

An object of the present invention is to enable further small sizing for an air cylinder apparatus by means of rationally and compactly assembling an electromagnetic valve, a circuit board for controlling, and so forth in an air cylinder, and to prevent the electromagnetic valve, the circuit board, air piping, and so forth from disturbing the work.

In order to achieve the objects, the air cylinder apparatus according to the present invention is characterized in being provided with a piston operating by means of action of pressurized air, an air cylinder provided with a pressure chamber for causing to act the pressurized air on the piston, and a control device being attached to the cylinder housing and controlling the air cylinder in an inside of the cylinder housing, in which the control device is constructed by attaching the electromagnetic valve for supplying and discharging the pressurized air from the pressure chamber, the circuit board on which a control circuit for controlling the electromagnetic valve is mounted, and a cover for covering the electromagnetic valve and the circuit board to a device-attaching surface of an adapter plate that is positioned at one end in a direction of an axial line of the cylinder housing which faces the direction of the axial line, and in which an output port of the electromagnetic valve and the pressure chamber are allowed to communicate with each other through an air through-hole provided in the adapter plate, and in which the circuit board is attached to an inside of the cover and occupies a position adjoining the electromagnetic valve, and in which the cover is detachably attached to the adapter plate together with the circuit board.

In the present invention, preferably, outer peripheral shapes of the cylinder housing, the adapter plate, and the cover are all rectangular shape, and a size of the rectangular shape of the adapter plate is equal to or less than a size of the rectangular shape of the cylinder housing, and the electromagnetic valve, the circuit board, and the cover are attached within a surface area of the device-attaching surface of the adapter plate.

Further, in the present invention, the adapter plate may serve as an end plate for obstructing one end of a cylinder hole through which the piston slides and the pressure chamber may be formed between the adapter plate and the piston.

Alternatively, the cover may be transparent and the electromagnetic valve and the circuit board may be able to be seen through from the outside across an entirety of the cover.

Furthermore, in the present invention, it is preferable that a sensor-attaching groove that is extending into the inside of the cover is formed on a side surface of the cylinder housing and the adapter plate, and a position sensor for detecting an operating position of the piston is attached to the sensor-attaching groove, and a lead wire led from the positioning sensor is introduced into the inside of the cover through the sensor-attaching groove, and is connected to the circuit board.

Alternatively, the air cylinder may be a double-action air cylinder, in which two pressure chambers are provided at both sides of the piston, respectively, and in which the electromagnetic valve is formed of a 5-port electromagnetic valve including two output ports, and in which the output ports may individually be allowed to communicate with the two pressure chambers through respective two air through-holes provided in the adapter plate.

According to the present invention, the air cylinder apparatus is constructed such that the electromagnetic valve and the circuit board are attached to the one end in the axial line direction of the air cylinder via the adapter plate, and the electromagnetic valve and the pressure chamber are allowed to communicate with each other through the air through-hole provided in the adapter plate, and that the electromagnetic valve and the circuit board are covered with the cover. Thereby, the electromagnetic valve, the circuit board, the air piping, and so forth can rationally be disposed within a diameter of the air cylinder compared to the air cylinder apparatus in which the electromagnetic valve, the air piping, and so forth are barely attached on the side surface of the air cylinder as those which are attached to the hitherto known air cylinder apparatus. As a result, not only the air cylinder apparatus can further be small-sized, but also the electromagnetic valve, the circuit board, the air piping, and so forth can be configured not to disturb the work by overhanging in a side surface direction of the air cylinder.

BEST MODE FOR CARRYING OUT THE INVENTION

An embodiment of an air cylinder apparatus according to the present invention is illustrated in FIG. 1 through FIG. 5. This air cylinder apparatus is formed by attaching a control device 2 for controlling an air cylinder 1 to one end in a direction of an axial line L of the air cylinder 1 being driven by means of pressurized air.

Figure 1:
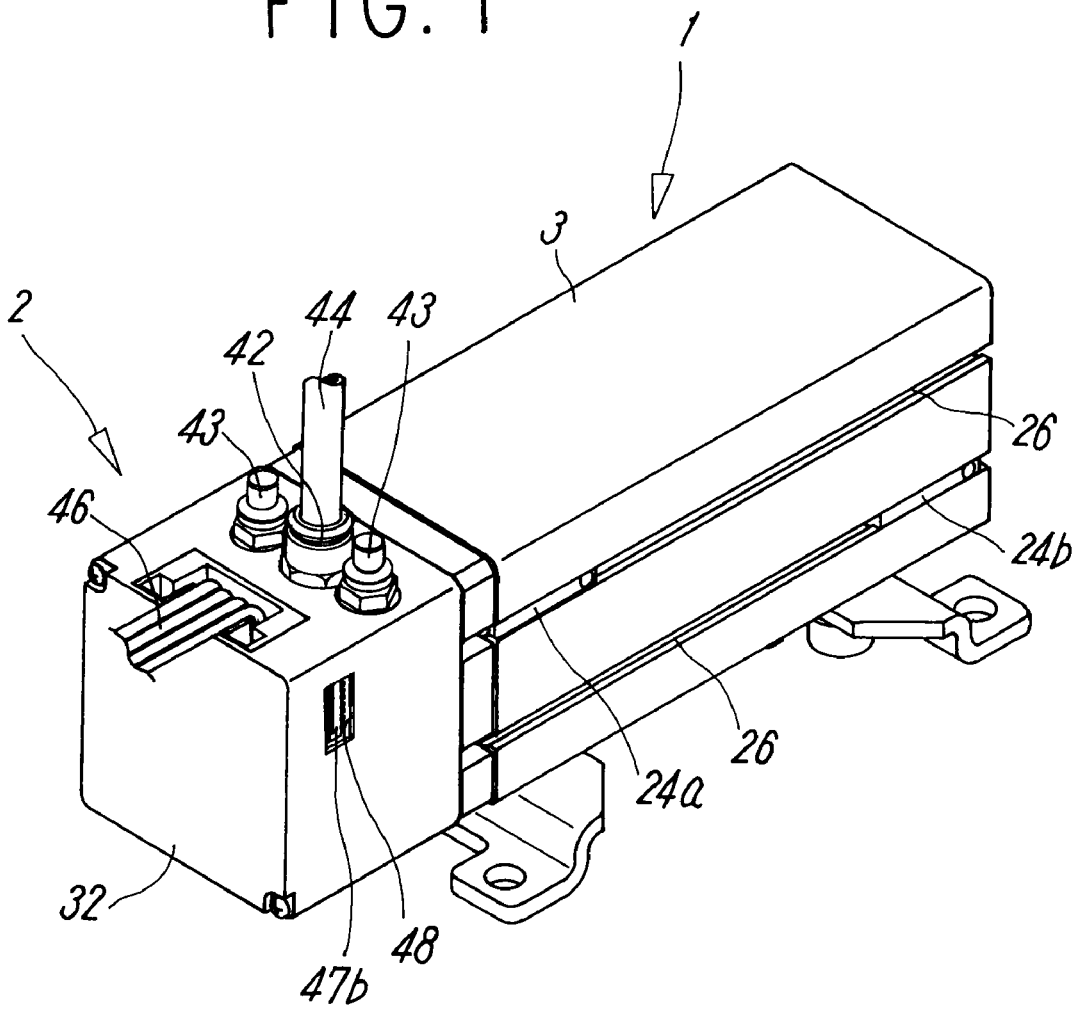
FIG. 1 is a perspective view illustrating an embodiment of an air cylinder apparatus according to the present invention.
Figure 2:
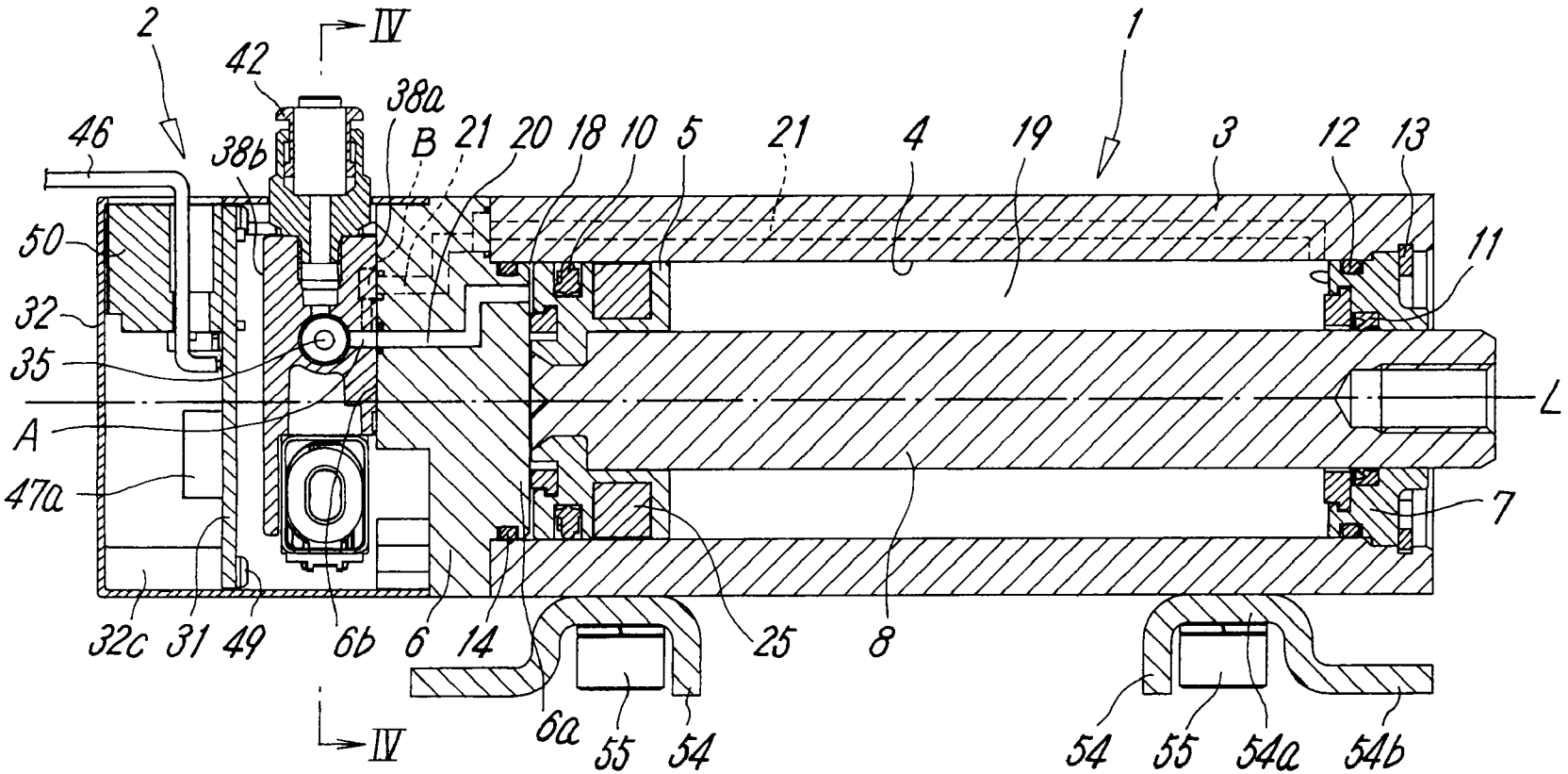
FIG. 2 is a cross-sectional view of FIG. 1.
Figure 3:
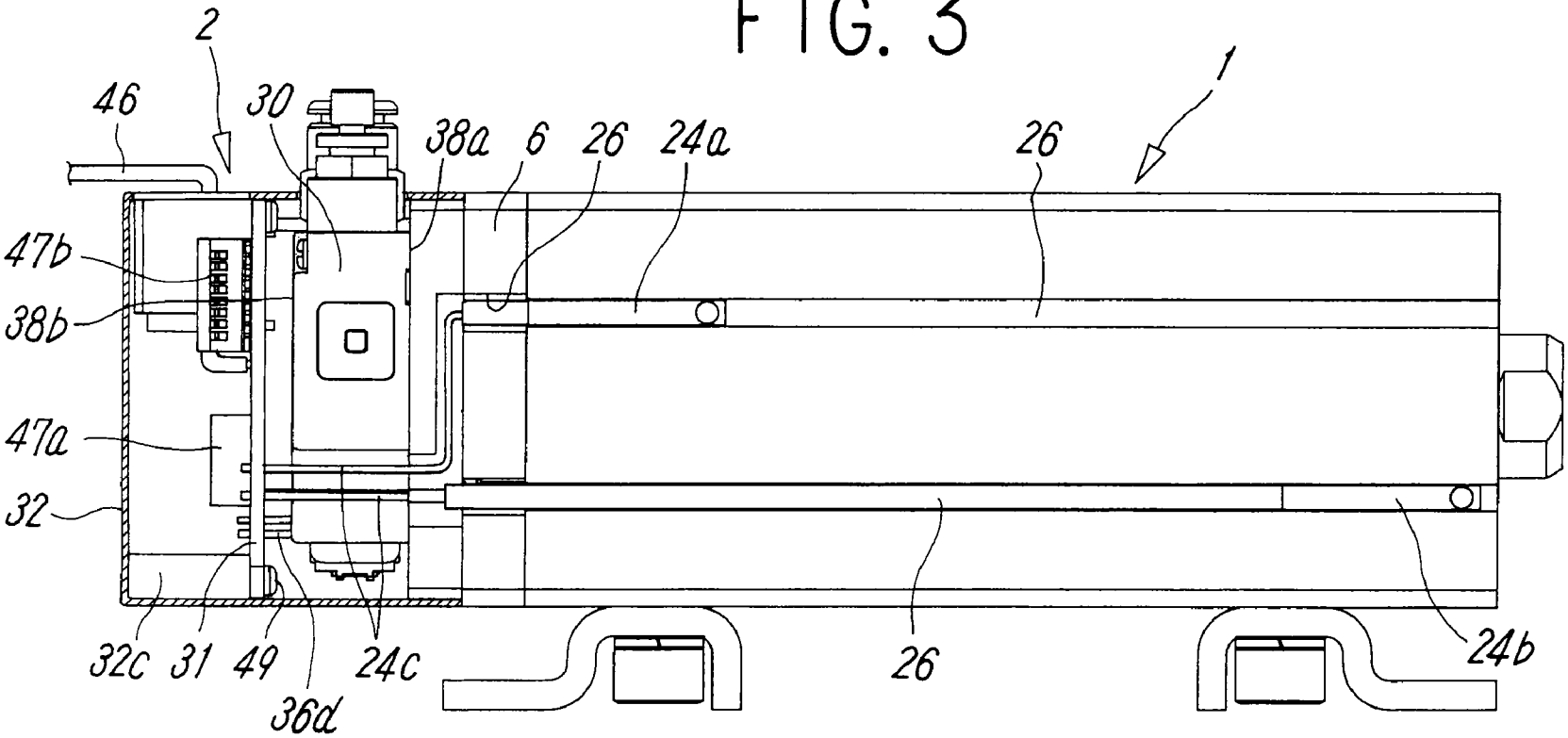
FIG. 3 is a side elevation of FIG. 1, illustrating the cover while breaking the cover.

The air cylinder 1 is provided with a hollow cylinder housing 3 having a rectangular outer peripheral shape, and as is clear from FIG. 2, a piston 5 is housed in a manner so as to be freely slid in the direction of the axial line L of a cylinder hole 4 in the round-shaped cylinder hole 4 in an inside of the cylinder housing 3. Both ends of the cylinder hole 4 are obstructed by end plates 6 and 7, respectively. Further, a base end portion of a piston rod 8 extending along the axial line L is coupled with one side of the piston 5, and a tip end portion of the piston rod 8 is extending to an outside of the cylinder housing 3 while air-tightly penetrating the end plate 7 at a side of the piston rod 8 (hereinafter sometimes referred to as rod-side end plate 7).

In the drawing, a reference numeral 10 denotes a sealing member being attached to an outer periphery of the piston 5, which seals a space between the outer periphery of the piston 5 and an inner periphery of the cylinder hole 4, a reference numeral 11 denotes a lip-shaped sealing member being attached to the rod-side end plate 7, which seals a space between an inner periphery of the end plate 7 and an outer periphery of the piston rod 8.

In two of the end plates 6 and 7, the rod-side end plate 7 has a round disk shape and is fitted into an inside of the cylinder hole 4 via a sealing member 12 in a manner so as not to protrude outward from the cylinder hole 4, and is fixed thereto with a C-shaped ring 13.

Figure 5:
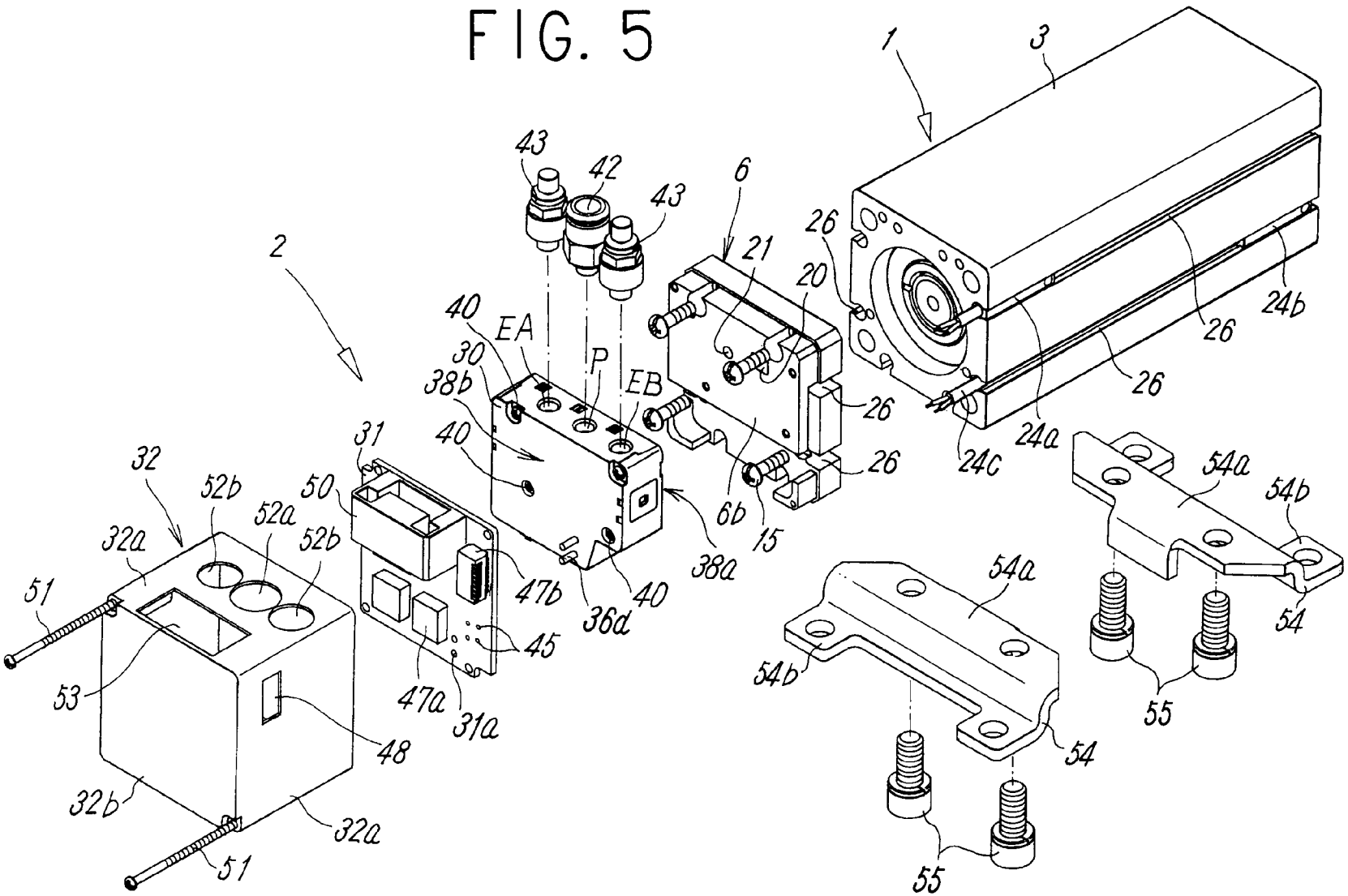
FIG. 5 is an exploded perspective view of FIG. 1.

In contrast, the end plate 6 at a head side has the same rectangular outer peripheral shape as that of the cylinder housing 3, and a size of the rectangular shape is in an extent approximately equal to or slightly less than that of the cylinder housing 3. A short cylinder-shaped fitting portion 6*a* is formed at an inside surface of the end plate 6, which faces a side of the cylinder housing 3. An end portion of the cylinder hole 4 is obstructed in an airtight manner by means of fitting the fitting portion 6*a* into the end portion of the cylinder hole 4 via a sealing member 14. The end plate 6 is detachably attached to an end surface of the cylinder housing 3 with four screws 15, as illustrated in FIG. 5.

A head-side pressure chamber 18 is formed between the piston 5 and the end plate 6 at the head side, and a rod-side pressure chamber 19 is formed between the piston 5 and the rod-side end plate 7. The piston 5 is configured to reciprocate in a direction of the axial line L together with the piston rod 8 by means of alternately supplying and discharging the pressurized air from the pressure chambers 18 and 19 through a first air through-hole 20 and a second air through-hole 21, respectively. Accordingly, the air cylinder 1 is a double-action air cylinder provided with the pressure chambers 18 and 19 at both sides of the piston 5, respectively.

In two of the first air through-hole 20 and the second air through-hole 21, the first air through-hole 20 being allowed to communicate with the head-side pressure chamber 18 opens at a device-attaching surface 6*b* of the end plate 6 upon penetrating the end plate 6 at the head side. Moreover, the second air through-hole 21 being allowed to communicate with the rod-side pressure chamber 19 extends in the inside of the cylinder housing 3 in the direction of the axial line L, and opens at another position on the device-attaching surface 6*b*, which is different from the position at which the first air through-hole 20 opens upon penetrating the end plate 6 at the head side.

An operating position of the piston 5 is configured to be detected by means of position sensors 24*a* and 24*b* that are attached to the cylinder housing 3. In order to perform the position-detecting operation, an annular permanent magnet 25 is attached to the piston 5 in a manner so as to surround the outer periphery of the piston 5. In contrast, sensor-attaching grooves 26 extending in the direction of the axial line L are formed two in number, respectively, on three surfaces other than an upper surface in the cylinder housing 3 and the end plate 6 at the head side. Each one of the magnet-sensing position sensors 24*a* and 24*b* formed of an autoswitch or the like is attached to the two sensor-attaching grooves 26 located on any one of the three surfaces. The position sensor 24*a* which is one of the two position sensors 24*a* and 24*b* is disposed at a position near the end plate 6 at the head side and is configured to detect a position of the piston 5 at a retreating stroke end. Further, the position sensor 24*b* which is the other of the two is disposed at a position near the end plate 7 at the rod side and is configured to detect a position of the piston 5 at an advancing stroke end.

A lead wire 24*c* lead from the two position sensors 24*a* and 24*b* passes through an inside of the sensor-attaching groove 26 and reaches the control device 2 upon passing through the end plate 6, and is thereafter electrically connected to a circuit board 31 of the control device 2 via a terminal 45.

The end plate 6 at the head side serves as an adapter plate for attaching the control device 2 to the air cylinder 1. Therefore, an outside end surface of the end plate 6 facing the direction of the axial line L serves as the device-attaching surface 6*b*, and various kinds of devices constituting the control device 2 are attached to the device-attaching surface 6*b*. Accordingly, in an explanation below with respect to the present embodiment, a component called "adapter plate 6" is the same member as the "end plate 6".

The control device 2 is constructed by mounting an electromagnetic valve 30 for supplying and discharging the pressurized air from the pressure chambers 18 and 19, the circuit board 31 on which a control circuit for controlling the electromagnetic valve 30 is mounted, and a cover 32 for covering the electromagnetic valve 30 and the circuit board 31 on the adapter plate 6.

Figure 4:
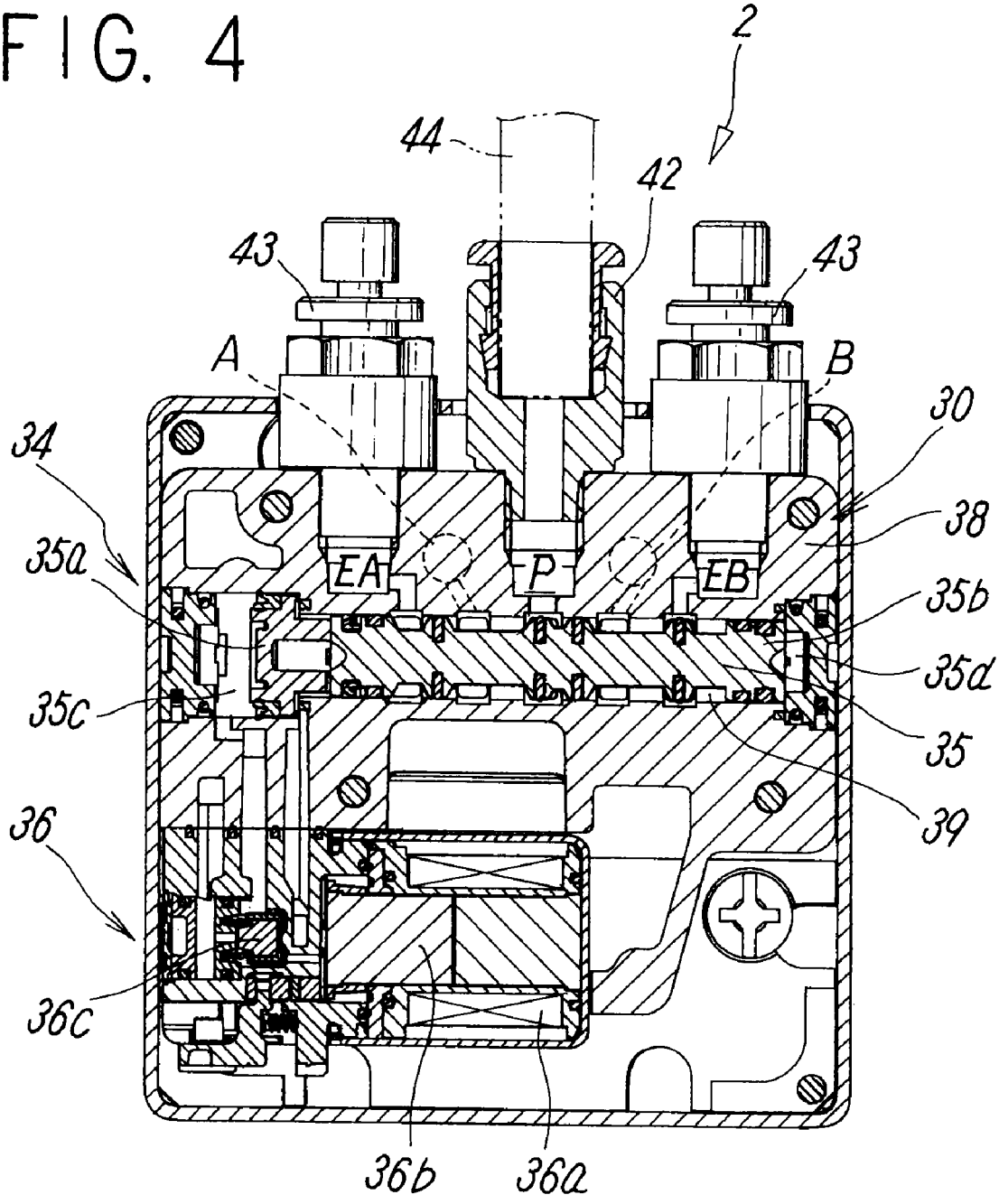
FIG. 4 is a cross-sectional view taken along a line IV-IV in FIG. 2.

The electromagnetic valve 30 is a pilot-type 5-port electromagnetic valve, and is composed of a main valve portion 34 constructed so as to switch a flow path with a spool 35 and an electromagnetic operation-type pilot valve portion 36 for driving the spool 35, and the pilot valve portion 36 is attached to a lower surface of the main valve portion 34, as illustrated in FIG. 4.

The main valve portion 34 has a 5-port type switching valve structure and is provided with a supplying port P opening at an upper surface of a valve housing 38, two of first and second discharging ports EA and EB, respectively, opening at both sides of the supplying port P at the upper surface, two of first and second output ports A and B opening at a first side surface 38*a* of the valve housing 38, a valve hole 39 with which each of the output ports A and B is allowed to communicate, and the spool 35 housed in the valve hole 39. A first spool piston portion 35*a* and a second spool piston portion 35*b* having different pressure-receiving areas with each other are formed at both ends of the spool 35. The first spool piston portion 35*a* having a large pressure-receiving area is formed of a piston member separately formed from the spool 35, and the second spool piston portion 35*b* having a small pressure-receiving area is integrally formed with the spool 35.

Furthermore, pilot air is supplied into or discharged from the pressure receiving chamber 35*c* of the first spool piston portion 35*a* by turning on or off the pilot valve portion 36 in a state that the pilot air is constantly supplied into the pressure-receiving chamber 35*d* of the second spool piston portion 35*b* through a pilot through-hole branching from the supplying port P. Thereby, the spool 35 is driven and the connecting condition of the flow path between the ports is switched.

The pilot valve portion 36 is constructed of a 3-port valve and operates a movable core 36*b* by means of electromagnetic force generated by power distribution to an exciting coil 36*a*, and opens and closes a pilot orifice by operating a valve member 36*c* with the movable core 36*b*. Thereby, pilot valve portion 36 is configured to supply and discharge the pilot air from the pressure-receiving chamber 35*c* of the first spool piston portion 35*a*. A plurality of coil terminals 36*d* (refer to FIG. 3 and FIG. 5) that is led to the exciting coil is protruded from a second side surface 38*b* at an opposite side of a first side surface 38*a* where the output ports A and B of the electromagnetic valve 30 open.

Accordingly, the electromagnetic valve 30 is a single pilot-type 5-port electromagnetic valve including one pilot valve portion 36. However, the basic construction and operation of such an electromagnetic valve is identical of that of the hitherto known electromagnetic valve, and therefore an explanation for that more than the above-described is omitted and the construction specifically related to the present embodiment will be explained below.

The electromagnetic valve 30 is disposed in a state of facing the supplying port P, and the discharging ports EA and EB upward, and contacting the first side surface 38*a*, at which two of the output ports A and B of the valve housing 38 open, with the device-attaching surface 6*b* of the adapter plate 6. The electromagnetic valve 30 is detachably attached to the device-attaching surface 6*b* with four screws 40. Currently, the electromagnetic valve 30 is positioned in a state of being completely housed within a surface area of the device-attaching surface 6*b*, and is configured not to protrude sideward from the adapter plate 6. Moreover, in two of the respective first and second output ports A and B, the first output port A is allowed to communicate with the first air through-hole 20 through the sealing member, and the second output port B is allowed to communicate with the second air through-hole 21 through the sealing member.

Accordingly, when the pressurized air is output from the first output port A by that the spool 35 of the electromagnetic valve 30 is driven to one of the switching positions, the pressurized air is supplied to the head-side pressure chamber 18 of the air cylinder 1 through the first air through-hole 20, and advances the piston 5 and the piston rod 8 from the position shown in FIG. 2. Currently, since the second output port B of the other side of the electromagnetic valve 30 is allowed to communicate with the second discharging port EB, the air in the rod-side pressure chamber 19 of the air cylinder 1 is discharged from the second air through-hole 21 to the outside through the second output port B and the second discharging port EB.

When the spool 35 is driven to the switching position of the opposite side, the supplying- and discharging-relationship for the pressurized air between two of the pressure chambers 18 and 19 is reversed from the above-described condition, and the piston 5 and the piston rod 8 retreat.

A pipe joint 42 of a simple connection type is attached to the supplying port P of the electromagnetic valve 30, and silencers 43 each provided with a speed controller is attached to two of the discharging ports EA and EB, respectively. The pipe joint 42 and the silencers 43 protrude from a surface area of the device-attaching surface 6*b* toward a lateral direction of the adapter plate 6.

Although the pipe joint 42 can connect an air tube 44 to a pipe-connecting orifice of the pipe joint 42 in a condition of preventing the air tube 44 from falling off only by simply plugging in, the structure itself is hitherto known and the hitherto known structure is used here without modification.

Further, the silencer 43 is constructed by combining the speed controller composed of a squeeze valve for limiting a discharging airflow amount from each of the discharging ports EA and EB and a check valve for preventing a reverse flow of the air to the discharging ports EA and EB, and an acoustic material formed of a porous material, and the same is also formed of a hitherto known construction.

The control circuit mounted on the circuit board 31 is a serial circuit for drive-controlling the electromagnetic valve 30 by means of a serial signal. The control circuit is constructed by performing a printed wiring operation for use in transmitting a driving voltage, and in transmitting the serial signal on the circuit board 31, and by mounting various kinds of electronic parts necessary for controlling the electromagnetic valve 30, such as, for example, electronic parts 47*a* such as, a signal-sampling device for sampling an operating signal of the electromagnetic valve 30 in a serial signal transmitted through a serial wiring 46, a signal converter for converting a detected signal from the position sensors 24*a* and 24*b* into a serial signal, and so forth, or an electronic parts (dip switch) 47*b* for setting an operation content of the electromagnetic valve 30 (accordingly, the air cylinder 1) and so forth on the circuit board 31.

The circuit board 31 is disposed in a direction perpendicular to the axial line L of the air cylinder 1 in the inside of the cover 32, and is detachably attached to a board-attaching portion 32*c* formed in the cover 32 with screws 49. When the cover 32 is attached to the adapter plate 6, the circuit board 31 is disposed in a manner so as to entirely cover the second side surface 38*b* of the electromagnetic valve 30 at a position adjoining the electromagnetic valve 30. Currently, the coil terminals 36*d* protruding from the second side surface 38*b* is configured to be electrically connected to circuit terminals 31*a* connected to the printed wiring of the circuit board 31 in a plug-in like manner.

The cover 32 is formed into a rectangular box shape with a transparent synthetic resin, and is provided with four flat side surfaces 32*a* and one flat end surface 32*b* for obstructing each one end of the four side surfaces 32*a*. Namely, the cover 32 is provided with the same rectangular outer peripheral shape as that of the cylinder housing 3 and the adapter plate 6, and the size of the rectangular shape is substantially identical of that of the adapter plate 6. Accordingly, when the cover 32 is attached to the adapter plate 6 with screws 51, the cylinder housing 3, the adapter plate 6 and the cover 32 are brought into a smoothly continuous state almost without forming any step on the outer peripheral surface thereof. Furthermore, the electromagnetic valve 30 and the circuit board 31 can be entirely seen through the cover 32.

When the screw 51 is detached, the cover 32 is detached from the adapter plate 6 together with the circuit board 31.

However, the size of the rectangular shape of the cover 32 may be smaller than the adapter plate 6. Even in this case, the electromagnetic valve 30, the circuit board 31, and the cover 32 are attached to the one end surface of the air cylinder 1 in an orderly fashion and compactly without protruding in a side surface direction of the air cylinder 1.

In the upper surface as one of the side surfaces 32*a* of the cover 32, three of pipe-connecting holes 52*a*, 52*b*, and 52*b* are provided at positions corresponding to the supplying port P, and two of the discharging ports EA and EB of the electromagnetic valve 30. The pipe joint 42 and the silencers 43 are extending out from the pipe-connecting holes 52*a*, 52*b*, and 52*b*, respectively. Accordingly, it is necessary to remove the pipe joint 42 and the silencers 43 form the electromagnetic valve 30 when the cover 32 is attached to or detached from the adapter plate 6.

Moreover, a wire-connecting hole 53 is provided at another position in the upper surface of the cover 32, and the serial wiring 46 is introduced from the wire-connecting hole 53 into the cover 32. In addition, the serial wiring 46 is connected to the printed wiring of the circuit board 31 through a wiring guide 50 of the circuit board 31. Although the serial wiring 46 is directly soldered with the circuit board 31 in the embodiment illustrated, it may be constructed that a male connector connected to the circuit board 31 is provided at a position of the wire-connecting hole 53, and a female connector attached to a tip end of the serial wiring 46 is connected to the male connector.

Further, a window hole 48 for operating the dip switch 47*b* is provided in another side surface 32*a* of the cover 32.

Two brackets 54 are attached to a lower surface of the cylinder housing 3 so that the air cylinder apparatus is attached to a predetermined installing position. The bracket 54 is provided with a fixing portion 54*a* for fixing the bracket 54 to the cylinder housing 3 with screws 55, and a seat portion 54*b* for fixing the bracket 54 to the predetermined installing position with bolts or the like.

The air cylinder apparatus is thus constructed, and the electromagnetic valve 30 and the circuit board 31 are attached to the device-attaching surface 6*b* of the adapter plate 6, which is positioned at one end in the direction of the axial line L of the air cylinder 1, and the electromagnetic valve 30 is allowed to communicate with the pressure chambers 18 and 19 through the air through-holes 20 and 21 provided in the adapter plate 6. Further, the electromagnetic valve 30 and the circuit board 31 are covered with the cover 32. Consequently, the electromagnetic valve 30, the circuit board 31, the air through-holes 20 and 21, and so forth can rationally be disposed within a diameter of the air cylinder 1, compared to the air cylinder apparatus in which the electromagnetic valve, the air piping, and so forth are barely attached on the side surface of the air cylinder as the hitherto known air cylinder apparatus. As a result, not only the air cylinder apparatus can further be small-sized, but the electromagnetic valve 30, the circuit board 31, the air through-holes 20 and 21, and so forth can be prevented from protruding in the side surface direction of the air cylinder 1 resulting in disturbing the work.

In the embodiment, although the end plate (namely, adapter plate) 6 of the air cylinder 1 is formed in a separate body from the cylinder housing 3 and attached to the cylinder housing 3, the end plate 6 may be integrally formed with the cylinder housing 3.

Alternatively, even in a case that the end plate 6 is integrally formed with the cylinder housing 3, or in a case that the same is formed in a separate body from the cylinder housing 3, it is possible to separately form the end plate 6 and the adapter plate 6 without causing the end plate 6 to serve as the adapter plate 6, and to attach the adapter plate 6 onto an end surface of the end plate 6.

Furthermore, in the embodiment, although the electromagnetic valve 30 is the single pilot-type 5-port electromagnetic valve including one pilot valve portion 36, a double pilot-type 5-port electromagnetic valve including two pilot valve portions can be used. In the double pilot-type electromagnetic valve, the pilot air is alternately supplied into or discharged from the pressure receiving chamber of the spool piston portion at both ends of the spool by means of two pilot valve portions. In this case, the pressure-receiving areas of the respective spool piston portions at respective ends of the spool may be equal to each other.

Alternatively, as the electromagnetic valve 30, two 3-port valves can be used instead of using one 5-port valve.

Moreover, in the embodiment, although the air cylinder 1 is a double-action air cylinder, the same may be a single-action air cylinder. As described above, in a case that the single-action air cylinder is used, a pressure chamber is formed only at one side of the piston 5, and a return spring is disposed at the other side of the piston 5. For example, in FIG. 2, it is applicable that the pressure chamber 18 is formed between the piston 5 and the end plate 6 at the head side and the return spring is disposed between the piston 5 and the end plate 7 at the rod side, and vice versa. Further, a 3-port valve is used as the electromagnetic valve 30.

The invention claimed is:

1. An air cylinder apparatus comprising:

an air cylinder comprising a piston operating via action of pressurized air, and pressure chambers that cause the pressurized air to act on the piston, in an inside of a cylinder housing; and a control device that controls the air cylinder while attached to the cylinder housing, wherein the control device is constructed by attaching an electromagnetic valve that supplies and discharges the pressurized air to the pressure chambers, a circuit board on which a control circuit that controls the electromagnetic valve is mounted, and a cover that covers the electromagnetic valve and the circuit board, to a device-attaching surface of an adapter plate disposed at one end in a direction of an axial line of the cylinder housing, which faces the direction of the axial line, and wherein the electromagnetic valve is fixed to the device-attaching surface of the adapter plate, and output ports of the electromagnetic valve and the pressure chambers are allowed to communicate with each other through respective air through-holes provided in the adapter plate, wherein the circuit board is attached to an inside of the cover and occupies a position adjoining the electromagnetic valve, wherein the cover is detachably attached to the adapter plate together with the circuit board, and wherein coil terminals of the electromagnetic valve are connected to circular terminals of the circuit board in a plug-in manner when the cover is attached to the adapter plate.

2. The air cylinder apparatus according to claim 1, wherein outer peripheral shapes of the cylinder housing, the adapter plate, and the cover are all rectangular shapes, and a size of the rectangular shape of the adapter plate is equal to or less than a size of the rectangular shape of the cylinder housing, and wherein the electromagnetic valve, the circuit board, and the cover are attached within a surface area of the device-attaching surface of the adapter plate.

3. The air cylinder apparatus according to claim 2, wherein the adapter plate serves as an end plate obstructing one end of a cylinder hole which the piston slides, and wherein the pressure chamber is formed between the adapter plate and the piston.

4. The air cylinder apparatus according to claim 3, wherein the cover is transparent and the electromagnetic valve and the circuit board are able to be seen through from outside across an entirety of the cover.

5. The air cylinder apparatus according to claim 3, wherein a sensor-attaching groove extending into an inside of the cover is formed on a side surface of each of the cylinder housing and the adapter plate, and wherein position sensors for detecting an operating position of the piston are attached to the sensor-attaching groove, and wherein a lead wire being led from the position sensors is introduced into the inside of the cover through the sensor-attaching groove and connected to the circuit board.

6. The air cylinder apparatus according to claim 2, wherein the cover is transparent and the electromagnetic valve and the circuit board are able to be seen through from outside across an entirety of the cover.

7. The air cylinder apparatus according to claim 2, wherein a sensor-attaching groove extending into an inside of the cover is formed on a side surface of each of the cylinder housing and the adapter plate, and wherein position sensors for detecting an operating position of the piston are attached to the sensor-attaching groove, and wherein a lead wire being led from the position sensors is introduced into the inside of the cover through the sensor-attaching groove and connected to the circuit board.

8. The air cylinder apparatus according to claim 1, wherein the adapter plate serves as an end plate obstructing one end of a cylinder hole which the piston slides, and wherein the pressure chamber is formed between the adapter plate and the piston.

9. The air cylinder apparatus according to claim 8, wherein the cover is transparent and the electromagnetic valve and the circuit board are able to be seen through from outside across an entirety of the cover.

10. The air cylinder apparatus according to claim 8, wherein a sensor-attaching groove extending into an inside of the cover is formed on a side surface of each of the cylinder housing and the adapter plate, and wherein position sensors for detecting an operating position of the piston are attached to the sensor-attaching groove, and wherein a lead wire being led from the position sensors is introduced into the inside of the cover through the sensor-attaching groove and connected to the circuit board.

11. The air cylinder apparatus according to claim 1, wherein the cover is transparent and the electromagnetic valve and the circuit board are able to be seen through from outside across an entirety of the cover.

12. The air cylinder apparatus according to claim 1, wherein a sensor-attaching groove extending into an inside of the cover is formed on a side surface of each of the cylinder housing and the adapter plate, and wherein position sensors for detecting an operating position of the piston are attached to the sensor-attaching groove, and wherein a lead wire being led from the position sensors is introduced into the inside of the cover through the sensor-attaching groove and connected to the circuit board.

13. The air cylinder apparatus according to claim 1, wherein the air cylinder is a double-action air cylinder, and is provided with two pressure chambers at both sides of the piston respectively, and wherein the electromagnetic valve is one 5-port electromagnetic valve and is provided with two output ports, and wherein the two output ports are individually allowed to communicate with two pressure chambers through respective two air through-holes provided in the adapter plate.

14. The air cylinder apparatus according to claim 1, wherein the electromagnetic valve is sandwiched between the adapter plate and the circuit board.

* * * * *